US006340336B1

(12) United States Patent
Loconte

(10) Patent No.: US 6,340,336 B1
(45) Date of Patent: Jan. 22, 2002

(54) GOLF PUTTER

(76) Inventor: Michael J Loconte, 3 Walnut Rd., Rocky Point, NY (US) 11778

( * ) Notice: Subject to any disclaimer, the term of this patent is extended or adjusted under 35 U.S.C. 154(b) by 0 days.

(21) Appl. No.: 09/535,470

(22) Filed: Mar. 26, 2000

(51) Int. Cl.[7] ..... A63B 53/04

(52) U.S. Cl. ..... 473/251; 473/256; 473/325; 473/330; 473/334; 473/340

(58) Field of Search ..... 473/324, 325, 473/340, 341, 334, 339, 336, 337, 251, 256, 305, 313, 131, 219, 409, 349, 330, 331, 242

(56) References Cited

U.S. PATENT DOCUMENTS 3,085,804 A * 4/1963 Pieper
3,989,257 A * 11/1976 Barr
4,077,633 A * 3/1978 Studen
4,162,074 A * 7/1979 Thomson
4,664,385 A 5/1987 Macera
4,795,158 A * 1/1989 Kuykendall
5,344,149 A * 9/1994 Miller
5,383,664 A * 1/1995 Epperson
5,467,987 A * 11/1995 Perkins
5,601,500 A * 2/1997 Shipley
5,728,009 A 3/1998 Shanaham
5,830,075 A * 11/1998 Hirose
5,863,262 A * 1/1999 Donofrio

* cited by examiner

*Primary Examiner*—Sebastiano Passaniti
(74) *Attorney, Agent, or Firm*—Michael I Kroll

(57) ABSTRACT

The present invention 10 discloses a putter head for a golf club designed to precisely strike the upper portion only of a golf ball 16 in order to make it roll truer. The club face has an upper vertical face 22 and a lower face 24 constructed at such an angle away from the golf ball so as to prevent contact with the lower part of the golf ball 16, and, having the shaft 18 connecting to the club head on the side of the club head 10 being usable by a right or left handed golfer. An alternative embodiment is provided wherein the shaft 18 connects intermediate of the club head 10 having grooves 36 therein for insertion of weights 38 onto the upper leading and trailing edges of the putter head for balancing the putter head 10.

5 Claims, 11 Drawing Sheets

| | |
|---|---|
| "A" | Upper vertical facing member |
| | Lower oblique facing member |
| "B" | Upper Hemisphere of Golf Ball, |
| "C" | Lower Hemisphere of Golf Ball, |
| "D" | Optimum Contact Area |
| "E" | Diameter of Golf Ball |

FIG 2B

GOLF PUTTER

BACKGROUND OF THE INVENTION

1. Field of the Invention

The present invention relates generally to golf clubs and, more specifically, to a golf putter having an improved putter head, which will prevent backspin on the golfball by using a club face wherein the club face is divided into an upper vertical facing member and a lower oblique facing member. The upper vertical facing member is situated within a parallel vertical planar surface as the club shaft and is of a distance from the ground that would permit contact only with the golfball on the upper half of the ball, thereby using minimal effort to increase the distance that the ball will travel. The lower oblique facing member recedes from the upper vertical facing member at an angle which prevents contact with the golfball, thereby eliminating reverse spin. In addition the opposite facing member is constructed in the same manner whereby the putter can be used by a left or right handed golfer.

In addition an alternate embodiment is provided having oppositely opposed grooves traveling the length of the clubhead whereby a golfer can slid a predetermined weight onto the proximal or distal top surface of the clubhead providing means for adjusting the balance of the putter.

2. Description of the Prior Art

There are many designs of golf putters which are available and may be suitable for the purposes for which they were designed, but they would not be as suitable as the present invention as hereinafter described. Typical of these is U.S. Pat. No. 4,162,074 issued to Thomson on Jul. 24, 1979.

Another patent was issued to Shanahan on Mar. 17, 1998 as U.S. Pat. No. 5,728,009. Another patent was issued to Perkins on Nov. 21, 1995 as U.S. Pat. No. 5,467,987. Yet another patent was issued to Macera on May 12, 1987 as U.S. Pat. No. 4,664,385. Still another patent was issued to Kuykendall on Jan. 3, 1989 as U.S. Pat. No. 4,795,158.

A golf putter having on its face a convex, parabolic protruding portion extending horizontally along the fact at a height such as to strike a golf ball slightly below its center. The convex protuberance provides only a very slight lift to the ball and imparts a substantial amount of overspin.

A golf putter comprising a head having an anterior putting face and a shaft secured to the head at the connection point. The connection point where the shaft is secured to the head is located distal to the midline extending through the putting face forwardly in an anterior direction along which the golf ball is propelled after being struck so that the shaft as it extends upwardly is directed from the distal side of the midline towards the proximal side thereof. The shaft in front view crosses a vertical plumb line intersecting the midline. The connection point is provided in a posterior section of the head displaced in the posterior direction from the anterior putting face. The shaft as it extends upwardly is inclined from the connection point towards the anterior direction. The center of gravity of the head is located forwardly in the anterior direction from the connection point and is located towards the proximal side of the head from connection point.

A golf putter having a club head with a striking face comprising a striking edge defined by at least two substantially planar surfaces which engages a golf ball at a point below the center of the golf ball and impairs a substantially immediate forward roll to the ball resulting in a truer path of travel of the ball and better control of putting distance.

A putter head adapted for attachment to a shaft has at least one planar surface adapted for striking a golf ball at a height greater than the radius of said golf ball to propel said golf ball in a desired direction. Preferably, the ball-striking surface is forwardly inclined at from 20" to 25" from the vertical, and most preferably, at 23.58" from the vertical.

A golf putter comprising a putter blade or head having a forwardly-angled striking face to impart immediate overspin to the ball being struck and said putter further including a relatively large square handle or grip for enabling alignment of the palm of the hand with the projected line of ball travel.

It is thus desirable to provide a golf putter having identical oppositely opposed facing members comprised of an upper vertical facing member and a lower oblique facing member. The upper vertical facing member being situated within the vertical planar surface of the shaft of the club and a lower oblique facing member which recedes from the upper vertical facing member at an angle which prevents contact with the golfball, thereby eliminating reverse spin.

SUMMARY OF THE PRESENT INVENTION

The present invention is a golf putter having an improved putter head which will prevent backspin on the golfball. The putter head has identical oppositely opposed club faces wherein each is divided into an upper vertical facing member and a lower oblique facing member. The upper vertical facing member is situated within a parallel vertical planar surface as the shaft of the club and is of a distance from the ground that would permit contact only with the golfball on the upper half of said ball, thereby increasing the distance that the ball will travel with minimal effort. The lower oblique facing member recedes from the upper vertical facing member at an angle which prevents contact with the golfball, thereby eliminating reverse spin. Also, the club can be used by right or left handed golfers.

In addition an alternate embodiment is provided having oppositely opposed grooves traveling the length of the clubhead whereby a golfer can selectively slid a predetermined weight onto the proximal or distal top surface of the clubhead providing means for adjusting the balance of the putter.

A primary object of the present invention is to provide a golf putter which will create only top spin after making contact with the ball.

Another object of the present invention is to provide a golf putter having identical oppositely opposed facing members comprising an upper vertical facing member and a lower oblique facing member. The upper vertical facing member being situated within the vertical planar surface of the shaft of the club and a lower oblique facing member which recedes from the upper vertical facing member at an angle which prevents contact with the golfball, thereby eliminating reverse spin.

Yet Another object of the present invention is to provide an additional embodiment having oppositely opposed grooves traveling the length of the clubhead whereby a golfer can selectively slid a predetermined weight onto the proximal or distal top surface of the clubhead providing means for adjusting the balance of the club.

Additional objects of the present invention will appear as the description proceeds.

The present invention overcomes the shortcomings of the prior art by providing a leg contoured lap tray whereupon a keyboard console and a pointing device may be positioned thereon.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 2*b* is a chart of the various pertinent relationships of the present invention, as shown in FIG. 2.

LIST OF REFERENCE NUMERALS

Figure 1:
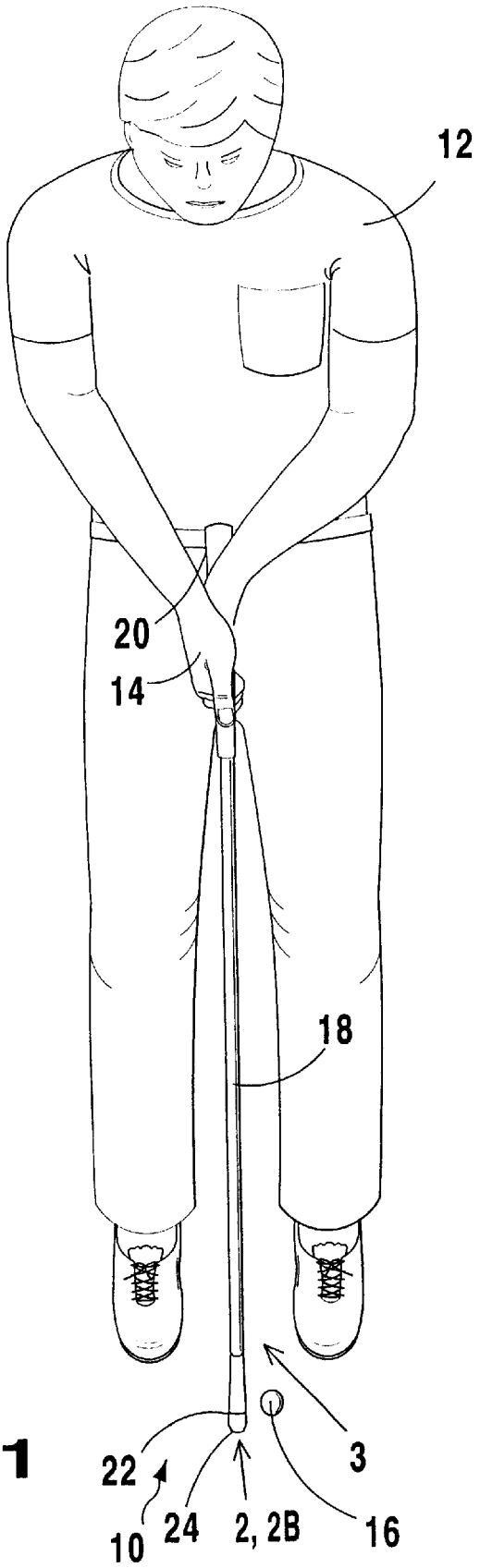
FIG. 1 is a perspective view of the present invention in use. Shown is the improved putter having identical oppositely opposed facing members comprised of an upper vertical facing member and a lower oblique facing member. The upper vertical facing member being situated within the vertical planar surface of the club shaft and a lower oblique facing member which recedes from the upper vertical facing member at an angle which prevents contact with the golfball, thereby eliminating reverse spin.

With regard to reference numerals used, the following numbering is used throughout the drawings.

10 present invention
12 user
14 hands
15 ground
16 golf ball
17 direction arrow
18 club shaft
20 club handle
22 upper face
23 point of intersection
24 lower face
25 space
26 shaded area
27 side of putter head
28 club face
30 lower half of golf ball
32 upper half of golf ball
34 angle
36 channels
38 weight
40 feet
42 intermediate point

DESCRIPTION OF THE PREFERRED EMBODIMENT(S)

Turning now descriptively to the drawings, in which similar reference characters denote similar elements throughout the several views, FIGS. 1 through 9 illustrate the present invention being an improved putter head for a golf club.

Turning to FIG. 1, shown therein is a perspective view of the present invention 10 in use in the hands 14 of a user 12. Shown is the improved putter 10 having identical oppositely opposed facing members comprised of an upper vertical facing member 22 and a lower oblique facing member 24. The upper vertical facing member 22 being situated within the vertical planar surface of the club shaft 18 and a lower oblique facing member 24 which recedes from the upper vertical facing member at an angle which prevents contact with the golfball 16, thereby eliminating reverse spin. The user 12 is shown holding handle 20 on shaft 18 of the golf club.

Figure 2:
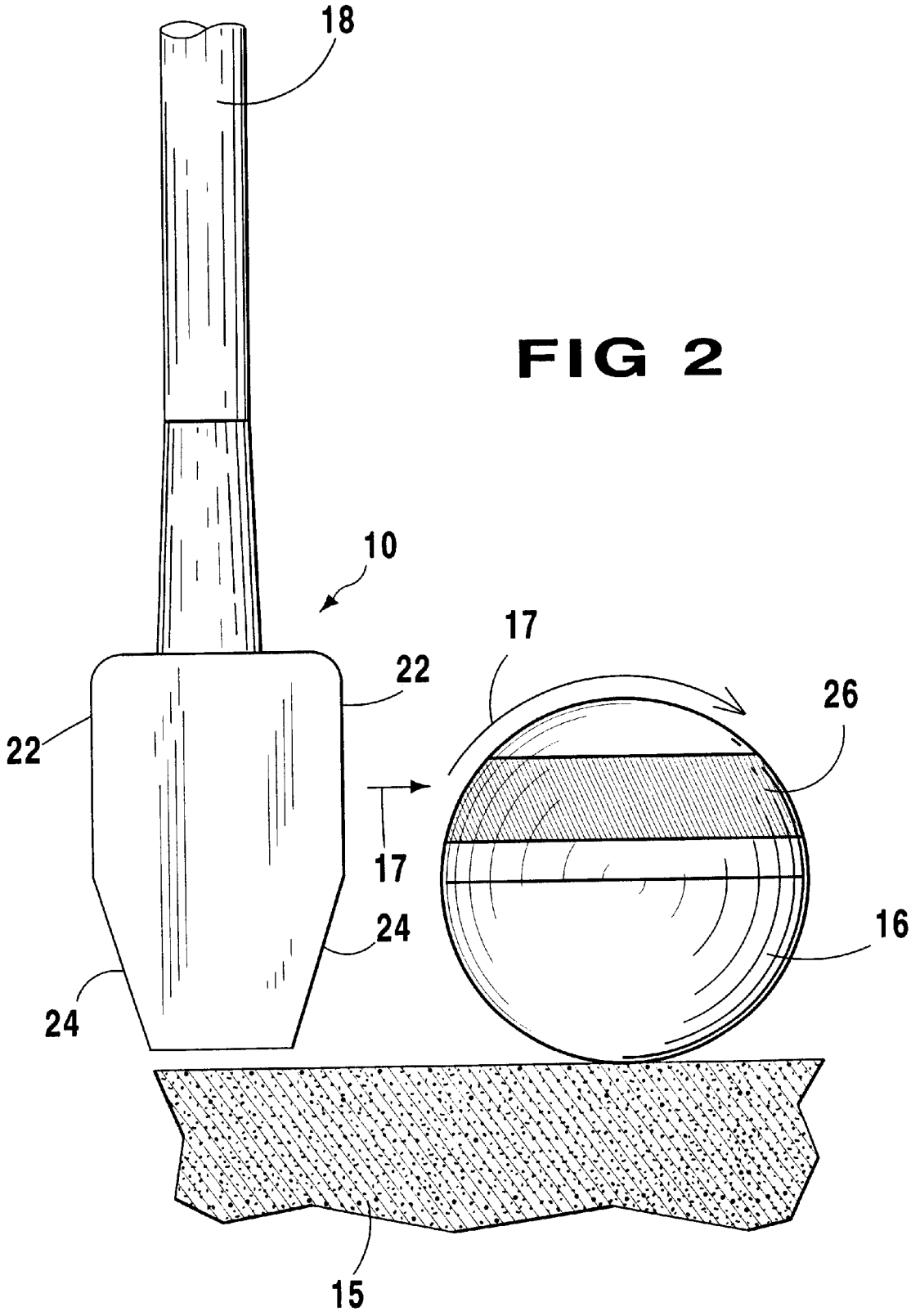
FIG. 2 is an enlarged front elevation view, taken from FIG. 1 as indicated, of the preferred embodiment of the present invention. Shown is a putter having identical oppositely opposed facing members comprised of upper vertical facing members and lower oblique facing members. The lower oblique facing member recedes from the upper vertical facing member at an angle which prevents contact with the golfball, thereby eliminating reverse spin. Also shown is a golf ball with a shaded area which represents the optimum contact area with the golf putter head.

Turning to FIG. 2, shown therein is an enlarged front elevation view, taken from FIG. 1 as indicated, of the preferred embodiment of the present invention 10. Shown is a putter 10 having identical oppositely opposed frontwardly and rearwardly facing members comprised of upper vertical facing members 22 and lower oblique facing members 24. The lower oblique facing member 24 recedes from the upper vertical facing member 22 at an angle which prevents contact with the golfball 16, thereby eliminating reverse spin. Also shown is a golf ball 16 with a shaded area 26 thereon which represents the optimum contact area with the golf putter head 10. Shaft 18 is also shown along with the ground 15 and direction arrows 17.

Figure 2A:
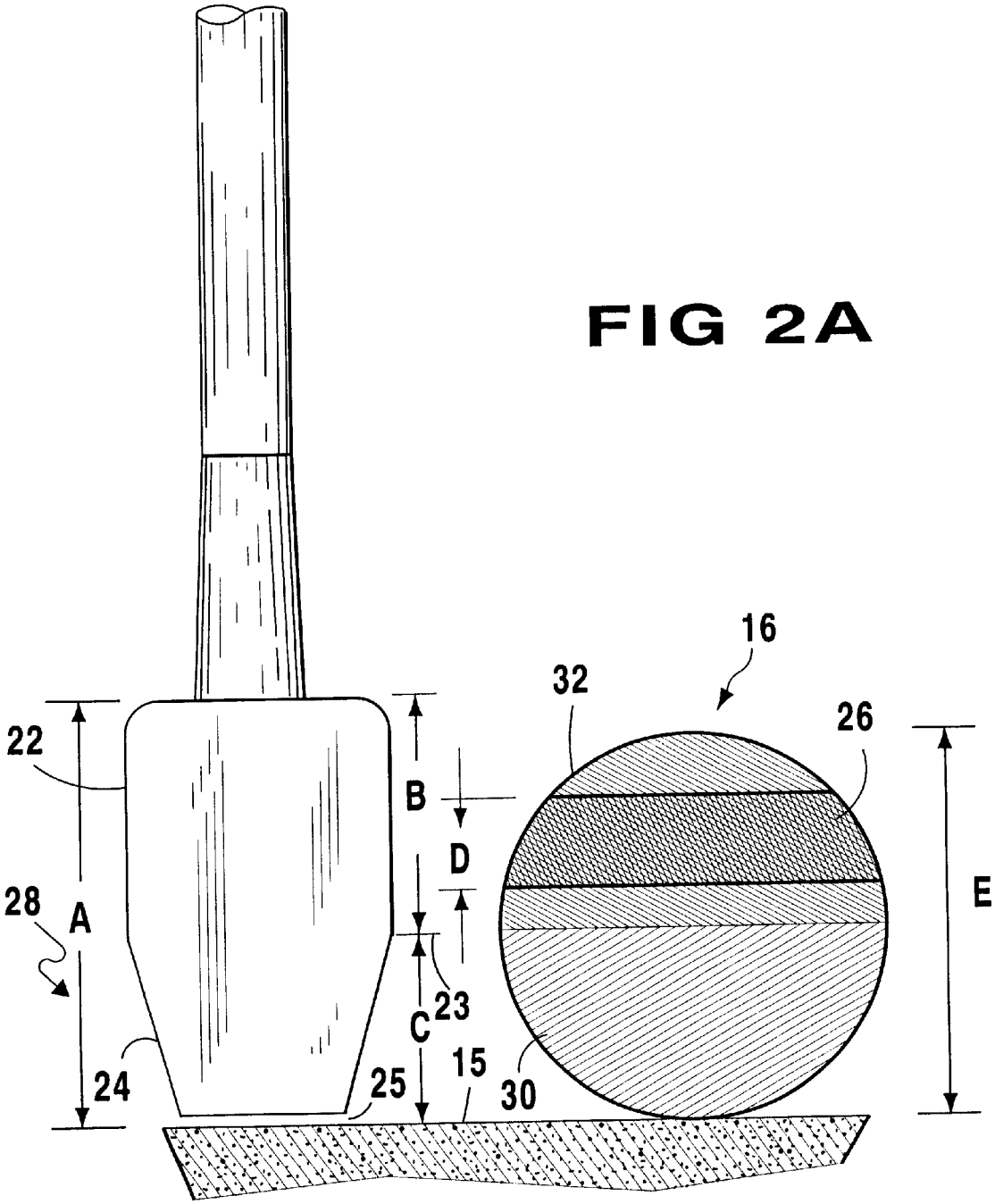
FIG. 2A is another enlarged front elevation view of the preferred embodiment of the present invention. Shown is a club face being equal to a height "A". The club height "A: being comprised of the upper vertical facing member and lower oblique facing member whose point of juncture is basically equal to the horizontal planar surface of the sphere, being comprised of a lower half of the golfball, shown by the letter "C" and the letter "B" comprising the upper and the letter "E". The circumferential area marked by the letter "D" denotes the optimal area for club ball contact.

Turning to FIG. 2A, shown therein is another enlarged front elevation view of the preferred embodiment of the present invention 10. Shown is a club face 28 being equal to a height "A". The club height "A" being comprised of the upper vertical facing member 22 and lower oblique facing member 24 whose point of intersection or juncture 23 is effectively equal to the radius of the golf ball sphere 16, being effectively comprised of a lower half 24 of the club face, shown by the letter "C" and the letter "B" comprising the upper half 22 which together approximates the distance shown by the letter "E" representing the actual diameter of ball 16 allowing for a small clearance space 25 between the club head 10 and ground 15. The circumferential area marked by the letter "D" denotes the optimal area for club head to ball 16 contact.

Turning to FIG. 2B, shown therein is a chart of the various pertinent relationships of the present invention 10, as shown in FIG. 2A as previously explained.

Figure 3:
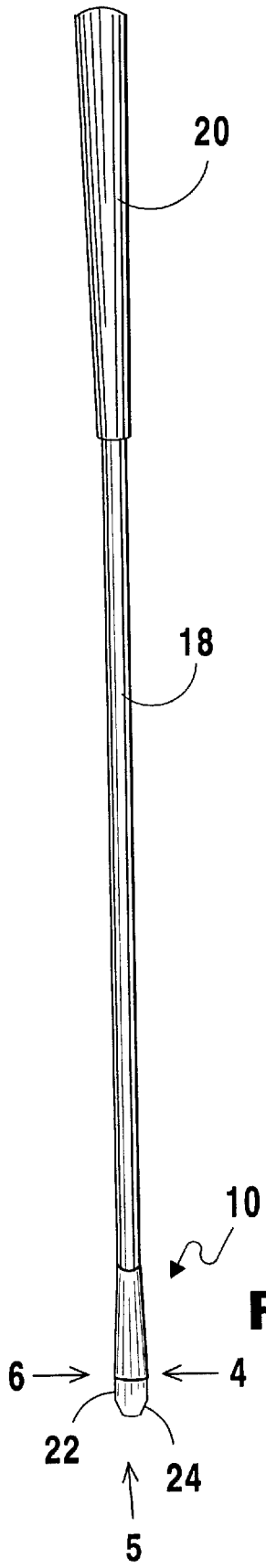
FIG. 3 is a front perspective view, taken from FIG. 1 as indicated, showing the golf putter.

Turning to FIG. 3, shown therein is a front perspective view, taken from FIG. 1 as indicated, showing the golf putter 10 along with shaft 18, handle 20 and upper and lower faces 22, 24.

Figure 4:
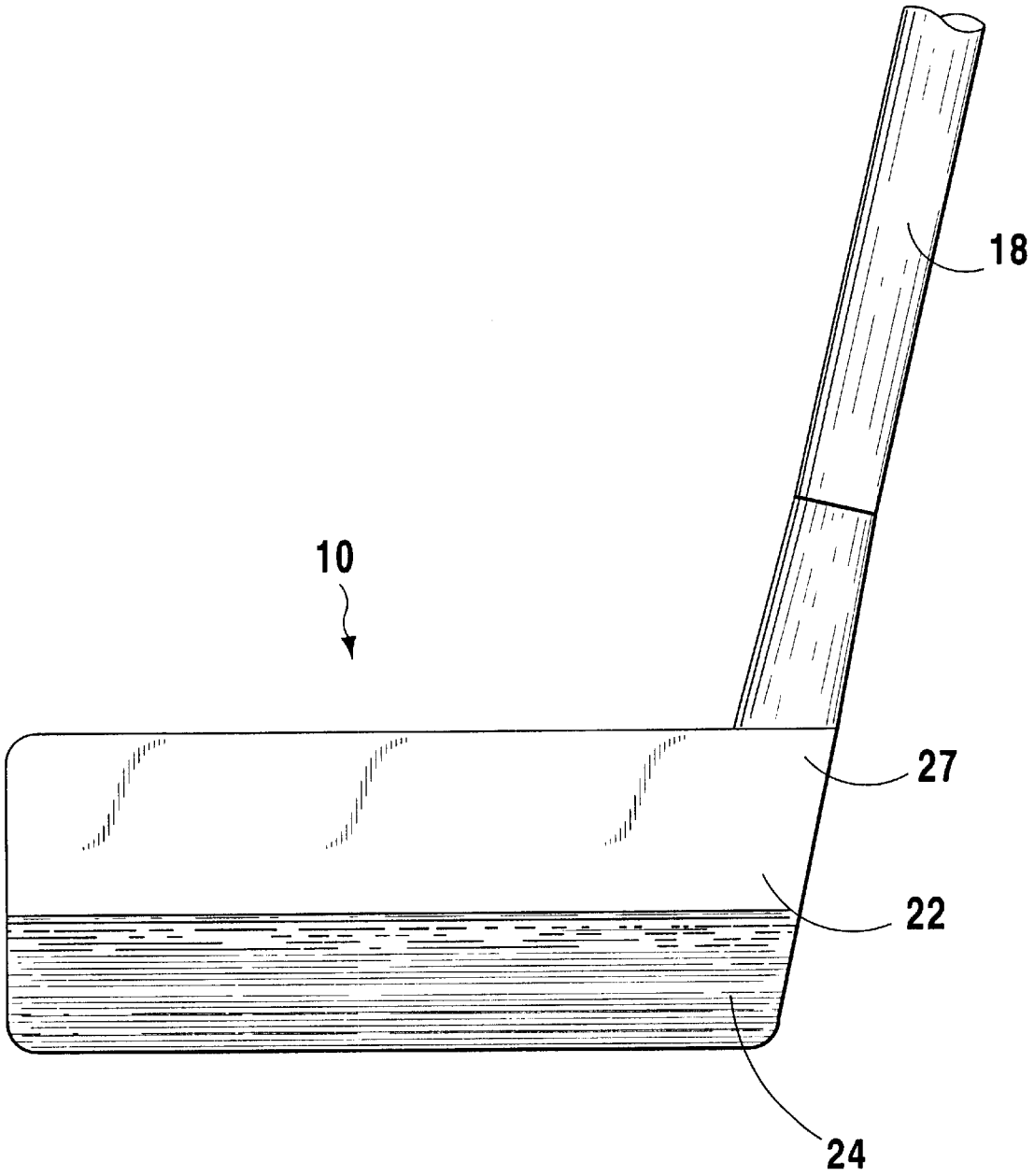
FIG. 4 is a side elevation view, taken from FIG. 3 as indicated, showing the face of the golf putter.

Turning to FIG. 4, shown therein is a side elevation view of the present invention 10, taken from FIG. 3 as indicated, showing the forward face of the golf putter 10 as would be used by a right handed user 12. Shaft 18 is shown along with upper and lower faces 22, 24. The angle formed by shaft 18 and putter faces 22, 24 is also shown. The shaft 18 is attached on the side or edge 27 of the putter head 10.

Figure 5:
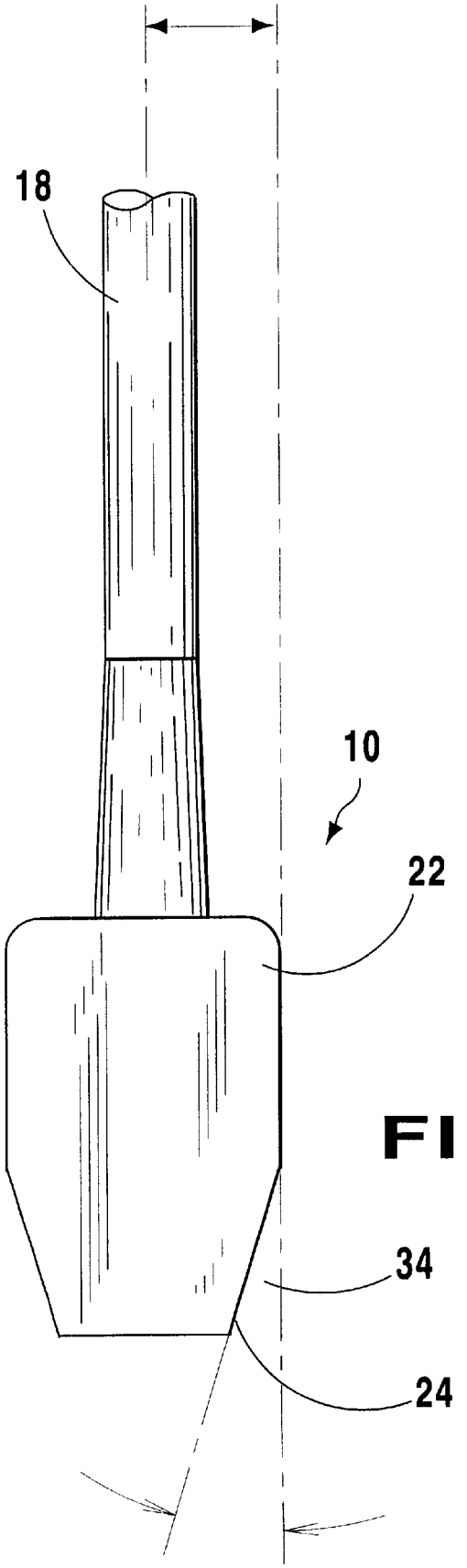
FIG. 5 is a front elevation view, taken from FIG. 3 as indicated. Showing the correlation of the vertical planar surfaces formed by the club shaft and the vertical facing member. Also shown is the degree of obliqueness used is used to prevent contact with the ball surface.

Turning to FIG. 5, shown therein is a front elevation view of the present invention 10, taken from FIG. 3 as indicated showing the correlation of the vertical planar surfaces formed by the club shaft 18 and the upper vertical facing member 22. Also shown is the degree of obliqueness shown by angle 34 used to prevent the lower face 24 from making contact with the ball surface.

Figure 6:
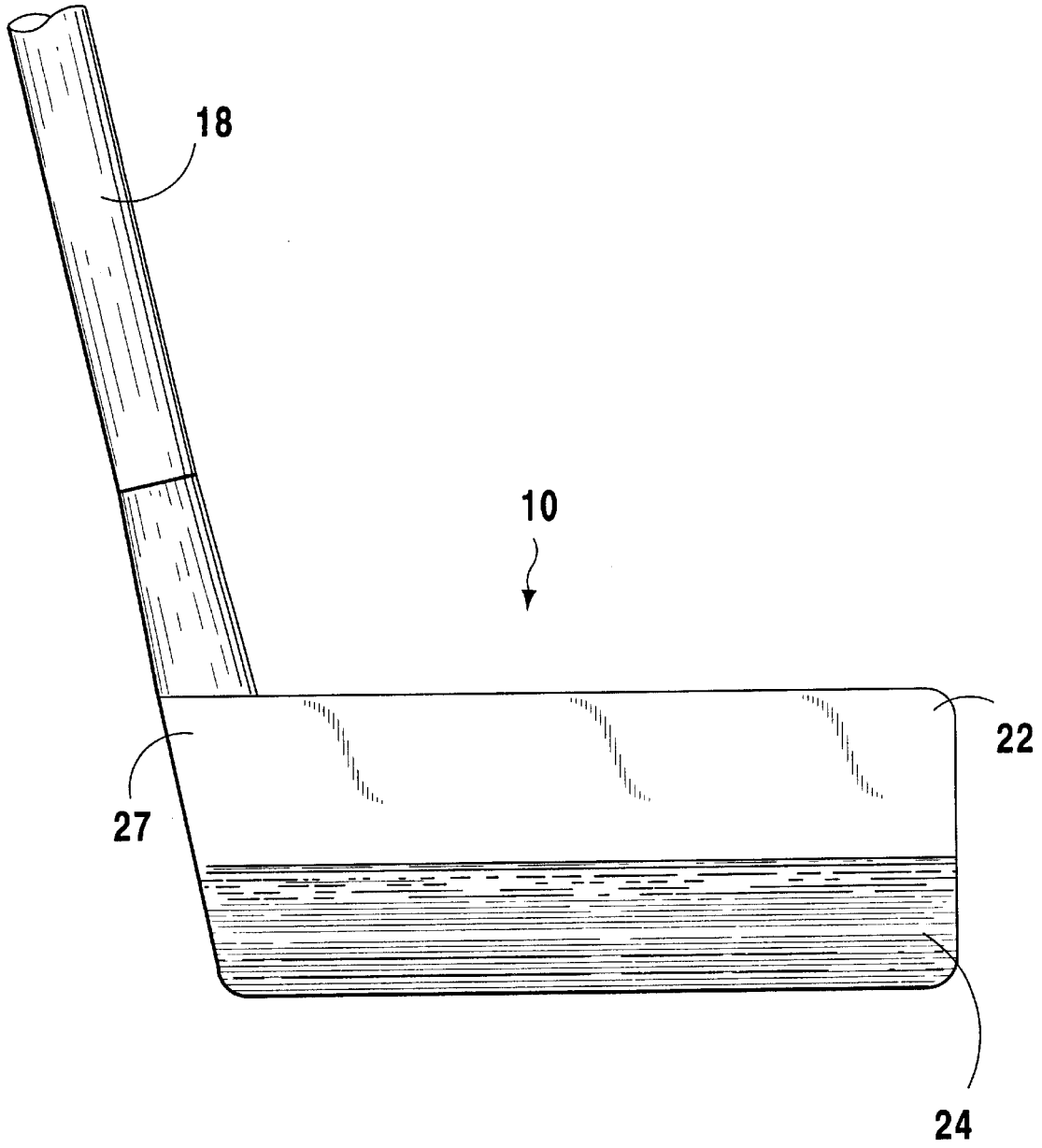
FIG. 6 is a side elevation view, taken from FIG. 3 as indicated, showing the opposite side of the putter.

Turning to FIG. 6, shown therein is a side elevation view of the present invention 10, taken from FIG. 3 as indicated, showing the opposite side of the putter 10 along with upper and lower surfaces 22, 24. Shaft 18 and side 27 is also shown. Since the front and rear faces 28 of the putter head 10 are mirror images of each other as shown by FIGS. 4 and 6, the putter can be used by a left handed or right handed golfer.

Figure 7:
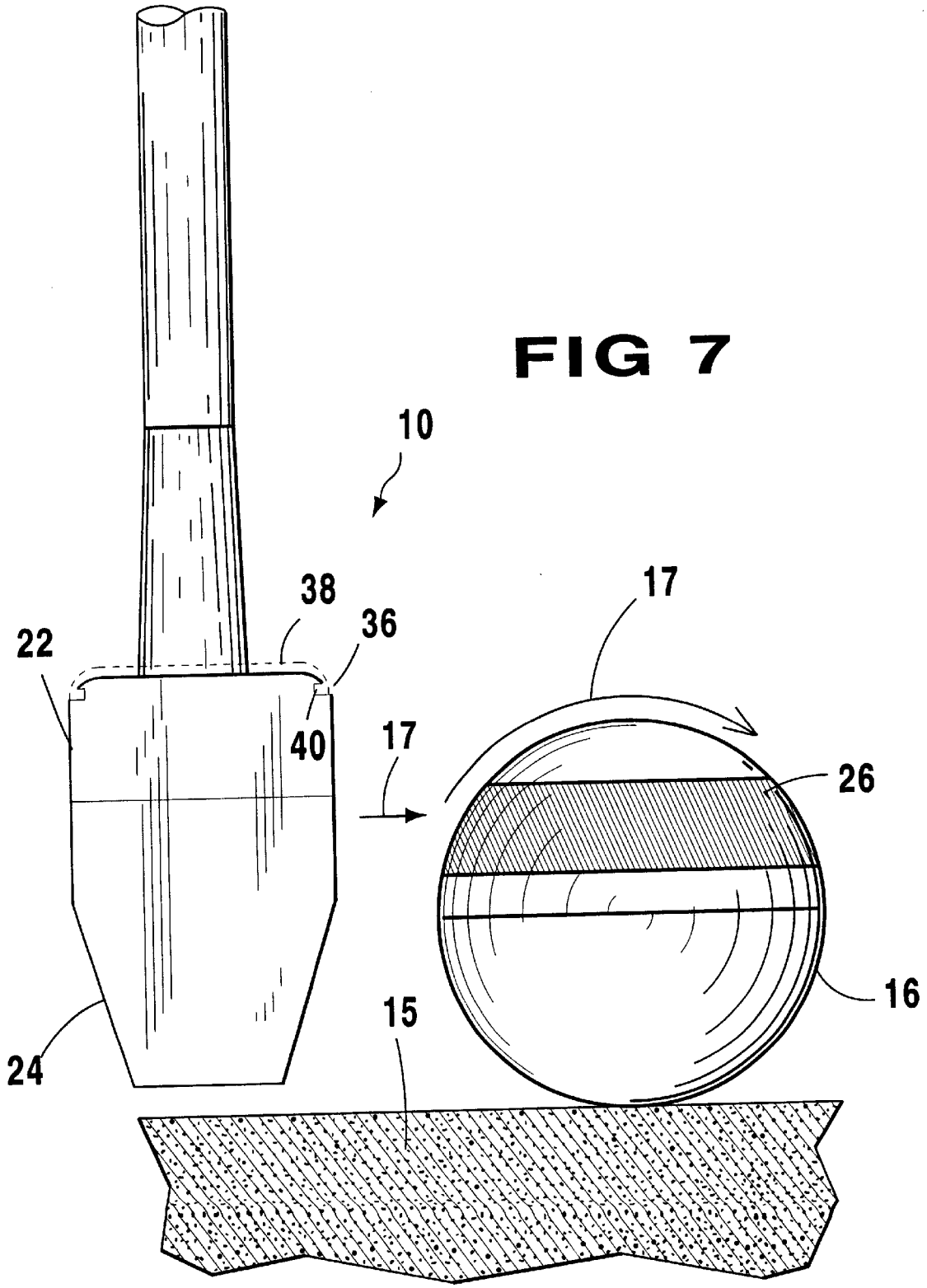
FIG. 7 is an front elevation view, of the alternate embodiment of the present invention. Shown is a putter having identical oppositely opposed facing members comprised of upper vertical facing members and lower oblique facing members. The lower oblique facing member recedes from the upper vertical facing member at an angle which prevents contact with the golfball, thereby eliminating reverse spin. Also shown is a golf ball with a shaded area which represents the optimum contact area with the golf putter head. In addition the vertical facing members have channels machined into the upper edge of the clubface whereby a golfer can selectively position a weight on either proximal or distal ends.

Turning to FIG. 7, shown therein is an front elevation view, of the alternate embodiment of the present invention 10. Shown is a putter 10 having identical oppositely opposed facing members comprised of upper vertical facing members 22 and lower oblique facing members 24. The lower oblique facing member recedes from the upper vertical facing member at an angle which prevents contact with the golfball 16, thereby eliminating reverse spin. Also shown is a golf ball 16 with a shaded area 26 which represents the optimum contact area with the golf putter head. In addition, the upper vertical facing members 22 have channels 36 machined longitudinally into the front and rear upper edge of the club face whereby a golfer can selectively slidingly position a weight 38 on either proximal or distal ends (see FIG. 8) of the putter head 10. The weight 38 has a pair of downwardly and inwardly projecting feet-like members 40 on its lateral edge which slide into grooves 36 to secure the weight 38 onto the putter head 10.

Figure 8:
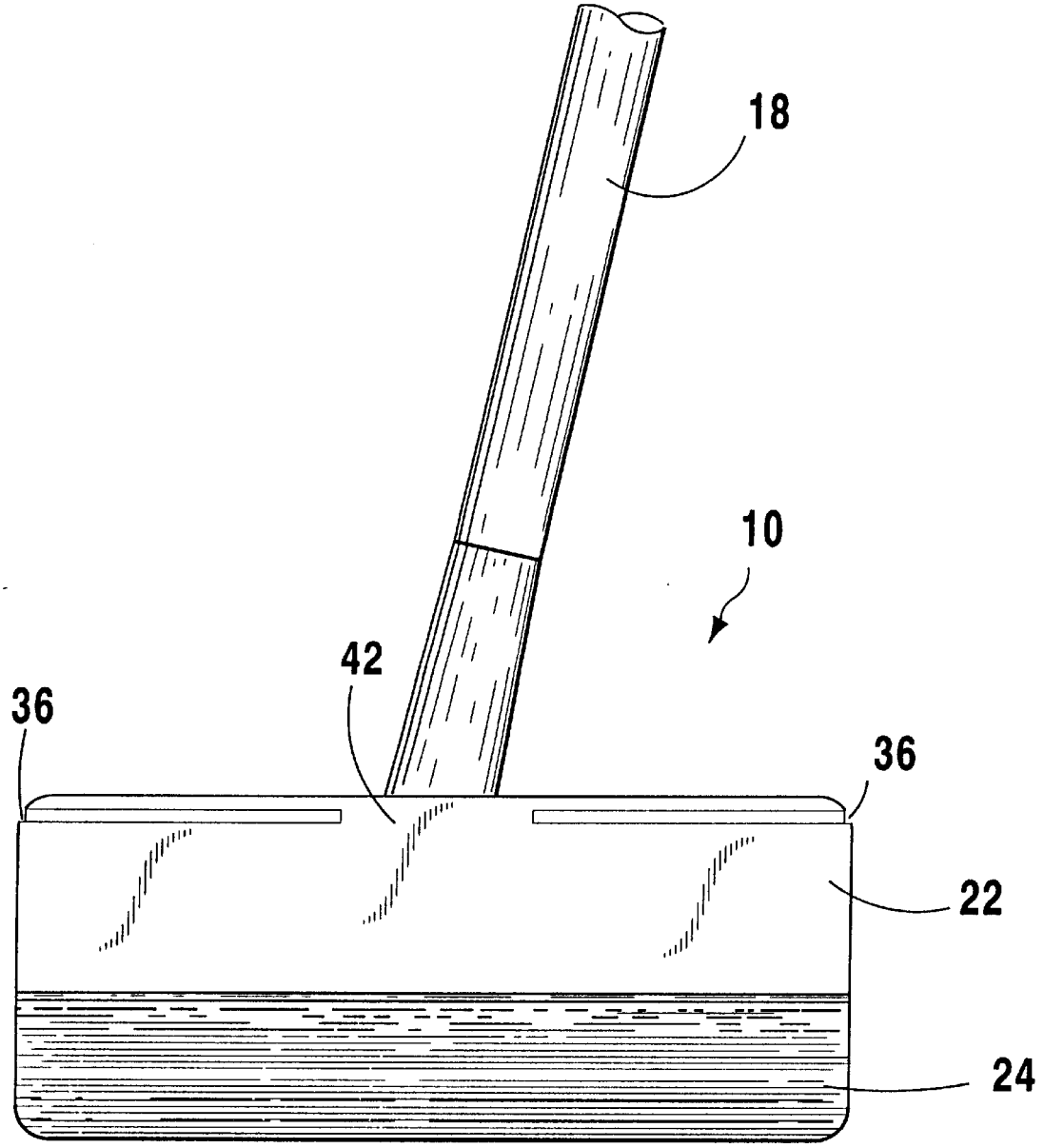
FIG. 8 is a side view of the alternate embodiment of the present invention. Shown is one of the grooves which will be manufactured as an integral device for the putter providing means for attaching a predetermined amount of weight to the clubhead. Therein change the balance of said club.

Turning to FIG. 8, shown therein is a side view of the alternate embodiment of the present invention 10. Shown is one of the channels or grooves 36 which will be manufactured as an integral device for the putter providing means for attaching a predetermined amount of weight (not shown) to the clubhead 10. Therein the user can change the balance of the club. Also shown is shaft 18 intermediately connected 42 to the club head 10 along with upper and lower faces 22, 24.

Figure 9:
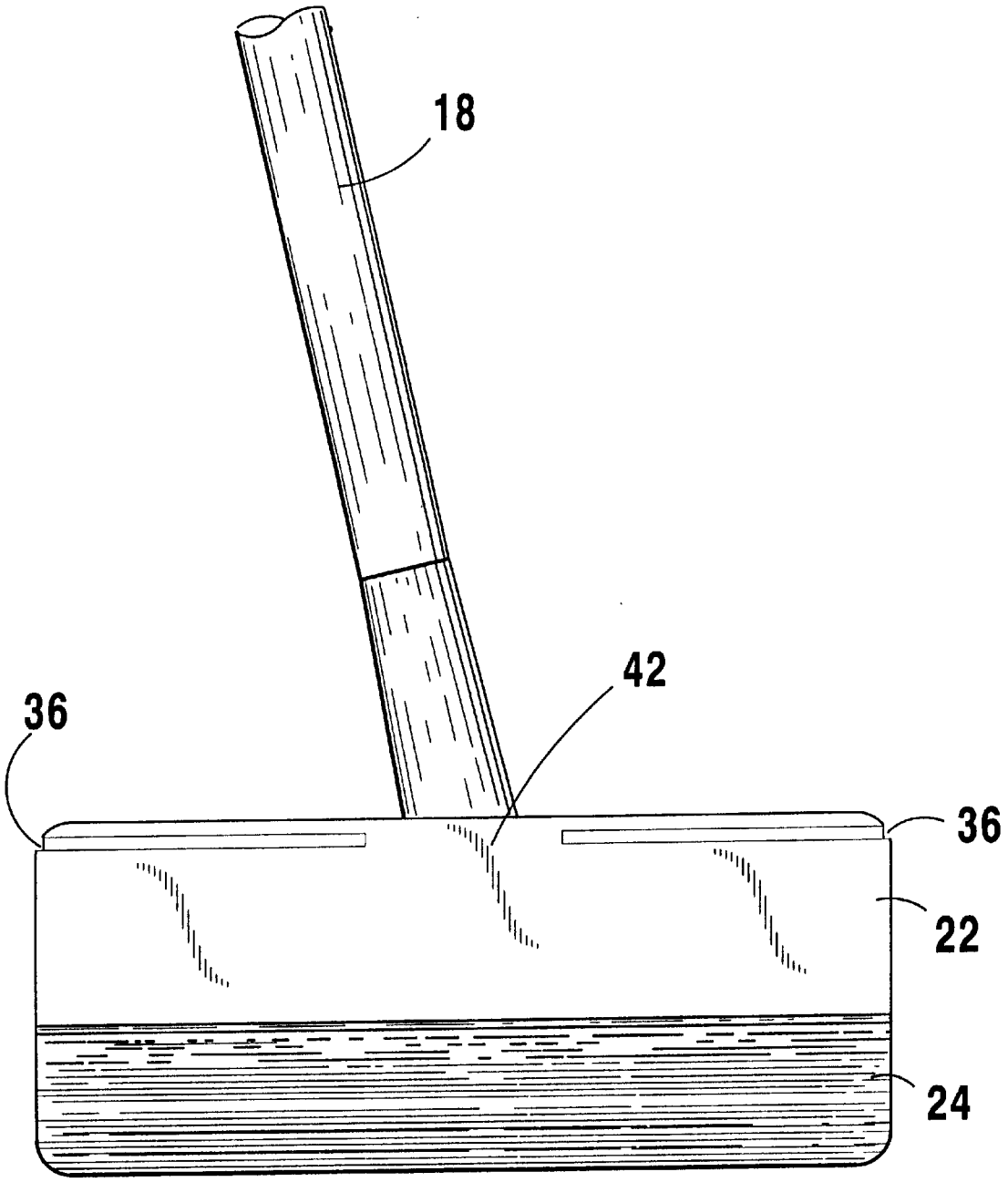
FIG. 9 is the other side view of the alternate embodiment of the present invention. Shown is the other groove which will be manufactured as an integral device for the putter providing means for attaching a predetermined amount of weight to the clubhead. Therein change the balance of said club.

Turning to FIG. 9, therein is shown the opposite side view from FIG. 8 of the alternate embodiment of the present invention 10. Shown is the other groove 36 which will be manufactured as an integral device for the putter providing means for attaching a predetermined amount of weight (not shown) to the clubhead 10. Thereby the user can change the balance of the club. Previously disclosed features are also shown.

What is claimed to be new and desired to be protected by Letters Patent is set forth in the appended claims:

I claim:

1. An apparatus for a golf club head for putting having a shaft and a head for striking a golf ball, the improvement comprising:

a) the putter head having a striking face, said face divided into an upper face and a lower face, said upper face and said lower face having a point of intersection;

b) said upper face being substantially vertical;

c) said lower face being formed at an angle away from the golf ball when positioned directly opposite said upper and lower faces;

d) said point of intersection of said upper face and said lower face located at a distance from the ground adapted to be effectively equal to the radius of the golf ball;

e) said putter head having a leading face and a trailing face, said leading face and said trailing face substantially forming mirror images of each other;

f) the shaft connecting to said putter head at a point intermediate the leading and trailing faces of said putter head;

g) means for attaching weights to said putter head;

h) grooves cut in and running longitudinally along an upper edge of said upper face for accepting weights; and i) said weights having downwardly and inwardly projecting feet, said feet communicating with said grooves for connecting said weights to said putter head.

2. The apparatus of claim 1, further comprising said feet located on said leading face of said putter head.

3. The apparatus of claim 1, wherein said weights slide onto said grooves.

4. The apparatus of claim 2, further comprising said feet located on said trailing face of said putter head.

5. The apparatus of claim 4, wherein said weights have various sizes for changing the balance of said putter.

* * * * *